US008286690B2

(12) United States Patent
Ohnaka

(10) Patent No.: US 8,286,690 B2
(45) Date of Patent: Oct. 16, 2012

(54) HIGH VACUUM SUCTION CASTING METHOD AND APPARATUS

(75) Inventor: Itsuo Ohnaka, Toyonaka (JP)

(73) Assignee: IE Solution Corporation, Toyonaka-shi (JP)

( * ) Notice: Subject to any disclaimer, the term of this patent is extended or adjusted under 35 U.S.C. 154(b) by 0 days.

(21) Appl. No.: 12/584,091

(22) Filed: Aug. 31, 2009

(65) Prior Publication Data

US 2009/0321036 A1 Dec. 31, 2009

Related U.S. Application Data

(63) Continuation of application No. PCT/JP2007/073637, filed on Nov. 30, 2007.

(30) Foreign Application Priority Data

Mar. 6, 2007 (JP) ..... 2007-098865

(51) Int. Cl.
*B22D 18/06* (2006.01)

(52) U.S. Cl. ..... 164/254

(58) Field of Classification Search ..... 164/63, 164/254, 499, 151.4, 119, 306
See application file for complete search history.

(56) References Cited

U.S. PATENT DOCUMENTS 7,004,224 B2 * 2/2006 Tsuzuki et al. ..... 164/312

FOREIGN PATENT DOCUMENTS

| | | | |
|---|---|---|---|
| JP | 59-45072 A | * | 3/1984 |
| JP | 61-135470 A | * | 6/1986 |
| JP | 4-158968 | | 6/1992 |
| JP | 8-174187 | * | 7/1996 |

* cited by examiner

*Primary Examiner* — Kevin P Kerns
(74) *Attorney, Agent, or Firm* — Fox Rothschild LLP

(57) ABSTRACT

A casting method and apparatus are provided capable of producing high-quality castings having extremely few defects attributable to entrainment of gas, oxide film and the like both economically and while conserving energy. The invention relates to a high-vacuum-suction casting apparatus for producing cast products by raising up molten metal and introducing the molten metal into a die above, having a holding furnace for retaining the molten metal, a die arranged above the holding furnace, a feeding tube for supplying the molten metal from the holding furnace to the die cavity, and a movable sealing member capable of opening and closing a space between the gate provided in a bottom of the die and the outlet of the feeding tube.

6 Claims, 4 Drawing Sheets

【Fig. 1】
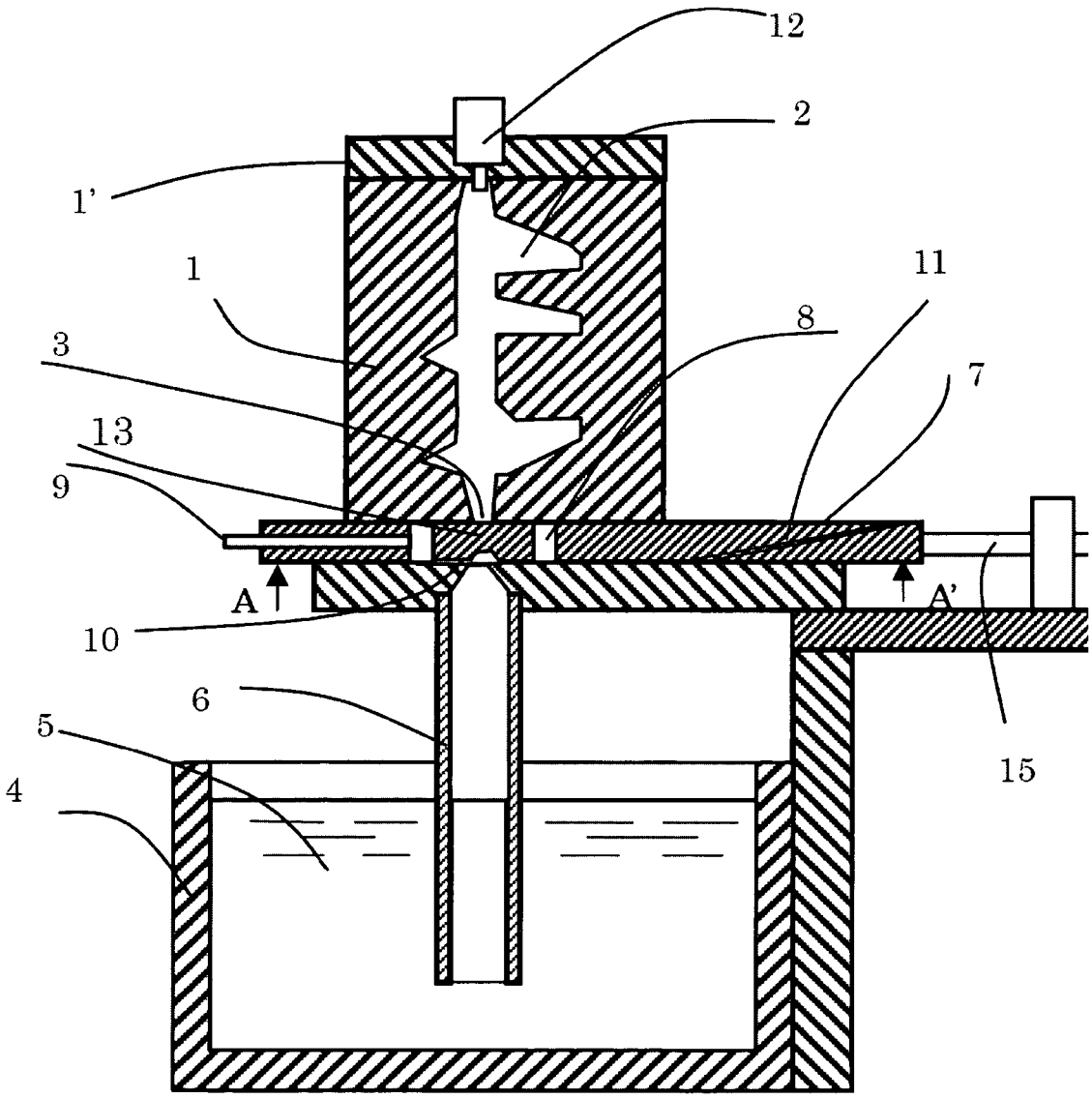

【Fig. 2】
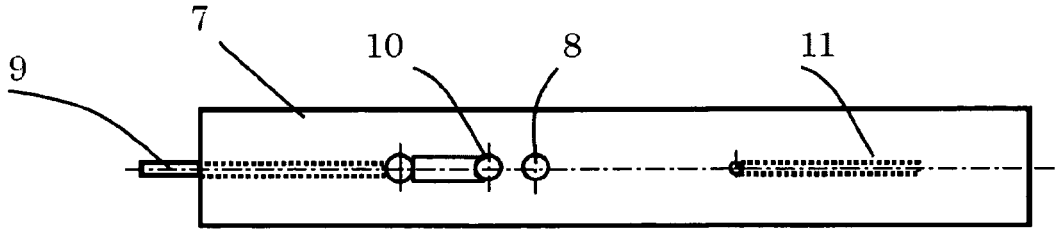
【Fig. 3】
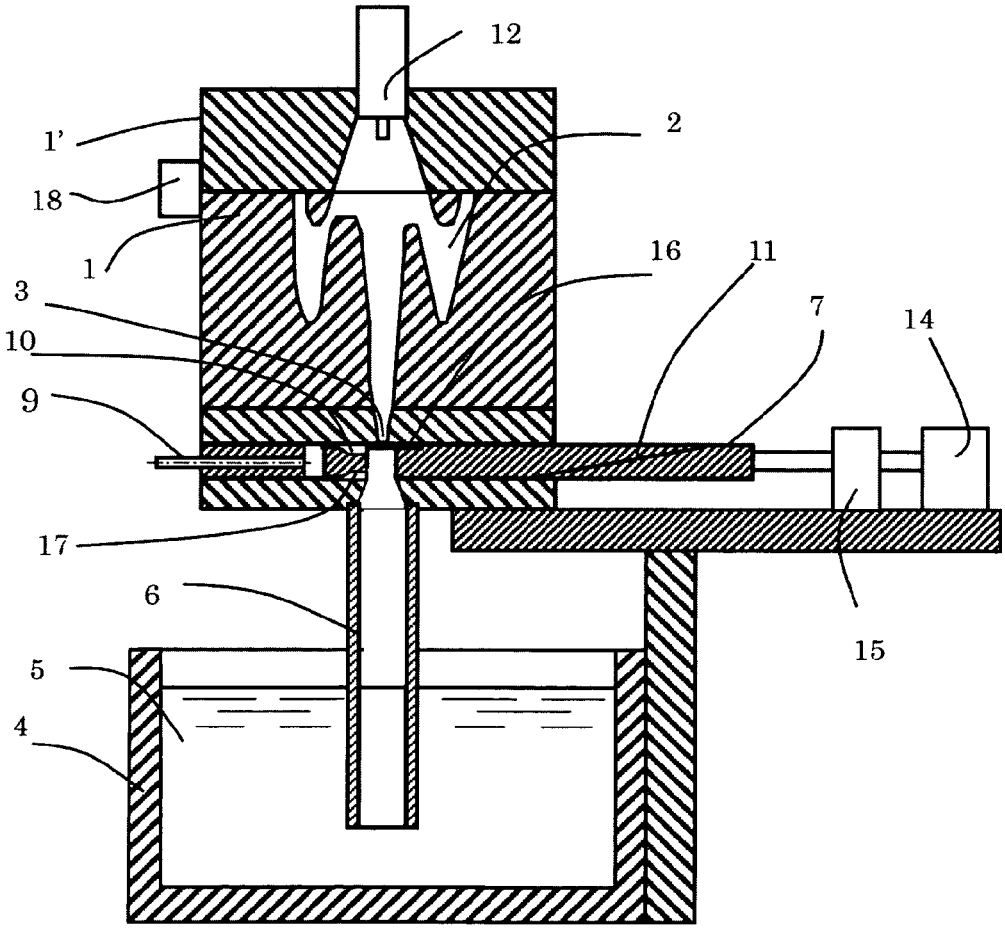

【Fig. 4】
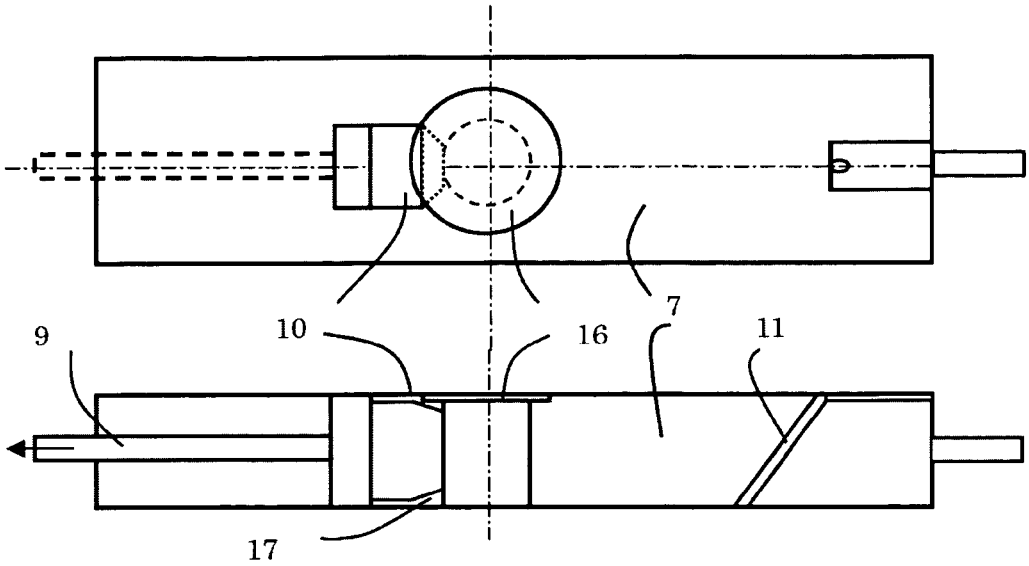
【Fig. 5】
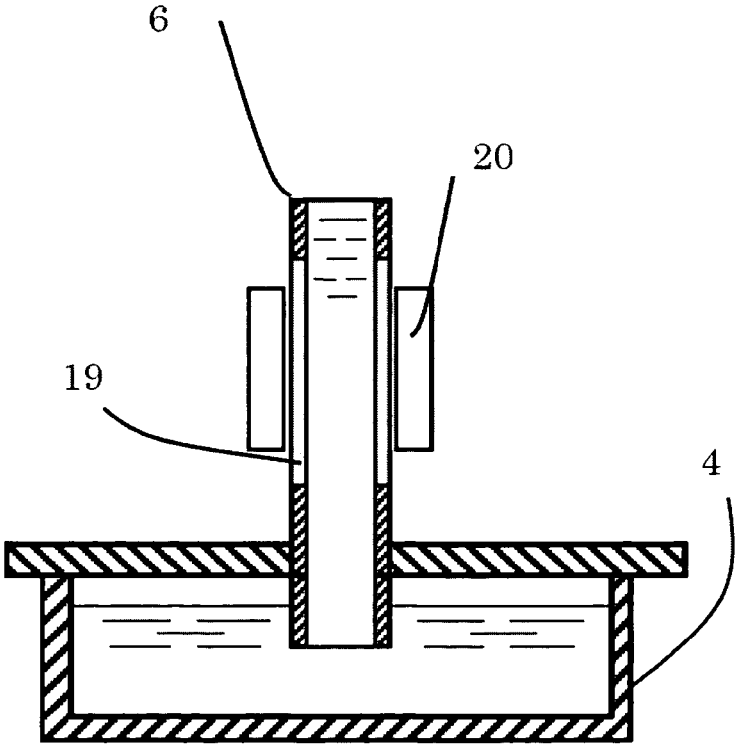

【Fig. 6】
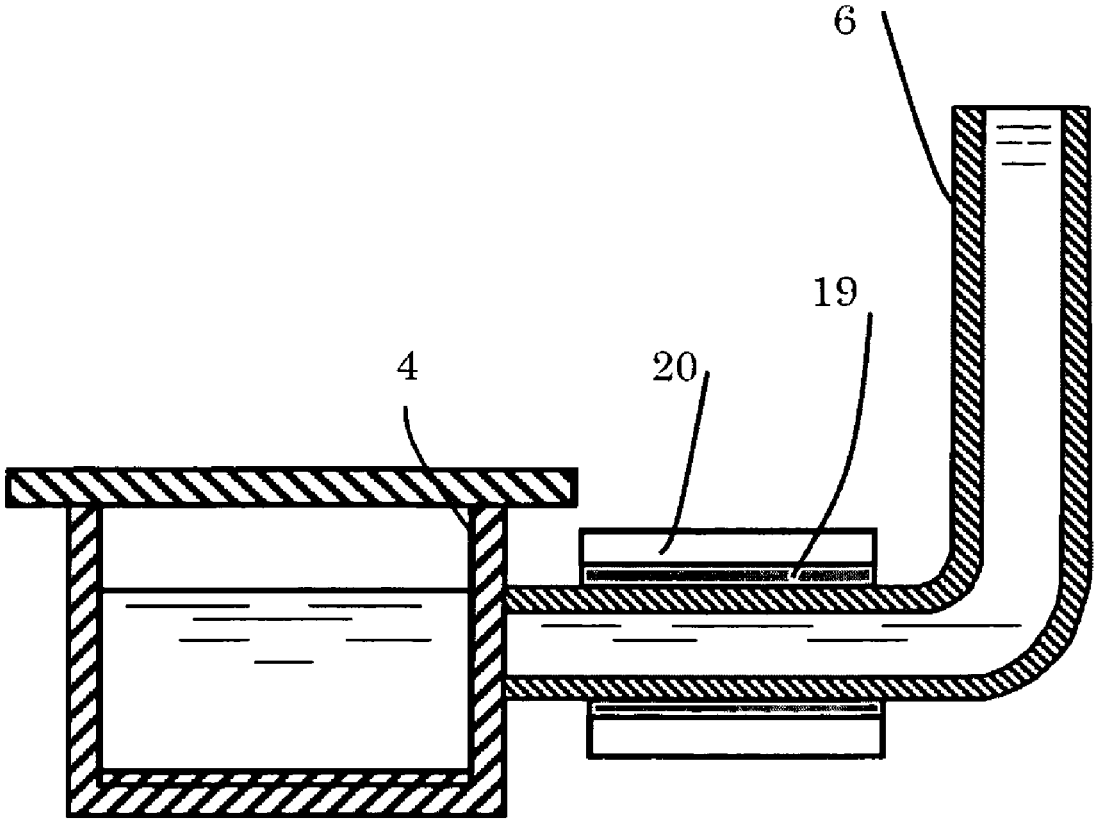

HIGH VACUUM SUCTION CASTING METHOD AND APPARATUS

This application is a continuation application of International Application PCT/JP2007/073637 filed Nov. 30, 2007, which in turn claims priority from Japanese Patent Application No. JP2007-098865 filed on Mar. 6, 2007. Both applications are incorporated herein by reference.

TECHNICAL FIELD

The present invention relates to a material processing method using solidification.

BACKGROUND ART

In casting processing or resin injection molding and the like using solidification of a melted material, air or other gas is entrained when filling the die cavity with molten metal resulting in gas defects, while the entrained minute amounts of gas and the like also contribute to the occurrence of shrinkage cavity defects. In particular, since oxide films easily form on the surface of the molten metal in the case of Al alloys or Mg alloys and the like, these films are easily entrained during the mold filling and causes inferior mechanical and chemical properties of the cast product, thereby making it desirable to prevent the formation of oxide films on the surface as well as different parts of the surface from colliding with each other.

Various casting methods have been developed in the past to accommodate such problems. For example, in a low pressure casting method, since molten metal is gently pushed up from the lower portion of a die to fill a die cavity, if the pressure acting on the surface of the molten metal in a holding furnace or a melting furnace can be suitably controlled over time, casting can be carried out without entraining gas and without causing different parts of the melt surface to collide with each other. However, this pressure control is not easy, and in the case of a shape such that the molten metal drops down in the die cavity in particular, there is susceptibility to entrainment of gas and oxide films on the melt surface. In addition, it is necessary to realize directional solidification such that solidification of the connection between the mold and feeding tube (gate) occurs at the final solidified location, thereby resulting in low productivity. In addition, it is difficult to pressurize unsolidified melt in the die cavity to prevent shrinkage defects.

A vacuum suction method has been applied practically for filling a die cavity while preventing oxidation of the melt surface by reducing pressure inside the die cavity instead of pressurizing the holding furnace to feed the molten metal. However, in this method, it is difficult to realize high vacuum due to movement of the surface, thus making it impossible to adequately prevent oxidation of the surface. Moreover, although gas is entrained into the die cavity unless the rate of depressurization is suitably controlled over time depending on the shape and dimensions of the die cavity, this control is not easy. In addition, productivity is also not satisfactory similar to low pressure casting methods of the prior art.

Although die casting methods have good productivity, in the case of a cold chamber system, the plunger sleeve is unable to be filled with molten metal resulting in the entrainment of gas and oxide film. Cold flakes formed as a result of the molten metal contacting the plunger sleeve are entrained and cause defects. Although a vacuum die casting method has been developed that reduces pressure in a short period of time after blocking the pouring hole with the tip of the plunger in order to prevent this gas entrainment, it is not easy to depressurize to a high vacuum in a short period of time similar to the previously described vacuum suction method. Consequently, although there are high vacuum die casting methods for realizing high vacuum by depressurizing both the die cavity and the holding furnace, these methods have not proliferated that much due to high equipment and maintenance costs. In addition, although ultra-high-speed injection die casting methods have been developed consisting of using a vacuum die casting method while increasing the gate speed beyond ordinary gate speeds, these methods are associated with increased equipment, maintenance and operating costs while also consuming large amounts of energy. Moreover, they also subject the die to a large load resulting in increased die costs and decreased dimensional accuracy.

Although squeeze casting methods result in little gas entrainment since gas in the plunger sleeve is able to be initially discharged, preventing the gas entrainment is not easy for the same reasons as in low pressure casting methods. In addition, the equipment is excessively high resulting in high building costs. Moreover, die costs are high due to the need to apply high pressure, thus resulting in a low degree of proliferation of this method.

With respect to die casting methods for Al alloy and the like, although the PF method attempts to demonstrate effects similar to a vacuum by filling the die cavity with oxygen and reacting with an alloy injected in the form of liquid droplets to form an oxide, it is not easy to completely remove gas.

In addition, although a hot chamber type of die casting method is able to prevent the formation of cold flakes in the plunger sleeve, it is difficult to prevent the gas entrainment for the same reasons as in the previously described cold chamber type of die casting methods, while durability of the plunger sleeve presents an additional problem with respect to Al alloys and the like.

In this manner, although various casting methods have been developed in the prior art, there has yet to be developed an ideal casting method that is free of entrainment of gas and oxide film of the surface of molten metal, has low equipment and maintenance costs, uses little energy, has small equipment dimensions and has good productivity.

SUMMARY OF THE INVENTION

A foremost object of the present invention is to provide a casting method and apparatus capable of producing high-quality castings having extremely few defects attributable to entrainment of gas, oxide film and the like both economically and while conserving energy.

BRIEF DESCRIPTION OF THE DRAWINGS

FIG. 1 is a side view of Example 1.

FIG. 2 is a view of a sealing plate used in Example 1 as viewed from below (A-A').

FIG. 3 is a side of Example 2.

FIG. 4 is a side view and an overhead view of a sealing plate used in Example 2.

FIG. 5 is a side view of Example 3.

FIG. 6 is a drawing showing another example of Example 3.

DESCRIPTION OF THE REFERENCE SYMBOLS

1, 1' Die
2 Die cavity
3 Gate
4 Holding furnace or melting furnace

5 Molten metal
6 feeding tube
7 Sealing plate
8 Opening
9 feeding tube depressurizing pipe
10 Pressure reduction vent
11 Gas ventilator
12 Pressurizing piston
13 Gate seal
14 Electric servo motor
15 Ball screw
16 Consumable seal
17 Pressure reduction vent (for molten metal cleaning)
18 Vacuum system connection
19 feeding tube cooling portion
20 Electromagnetic stirrer

DETAILED DESCRIPTION OF THE INVENTION

As a result of conducting extensive studies in consideration of the above-mentioned problems of the prior art, the inventor of the present invention found that the object described above can be achieved by using a production method and apparatus having a specific configuration, thereby leading to completion of the present invention.

Namely, the present invention relates to a high-vacuum-suction casting apparatus and high-vacuum-suction casting as described below.

1. A high-vacuum-suction casting apparatus for producing cast products by raising up molten metal and introducing the molten metal into a die above, comprising:
(1) a holding furnace for retaining the molten metal;
(2) the die arranged above the holding furnace;
(3) a feeding tube for supplying the molten metal from the holding furnace to the die cavity; and
(4) a movable sealing member capable of opening and closing a space between the gate provided in a bottom of the die and the outlet of the feeding tube, wherein the sealing member comprises: a) a pressure reduction vent for removing the surface portion of the molten metal sucked into the feeding tube by reducing pressure in the feeding tube; b) a depressurizing pipe for discharging aspirated gas from the pressure reduction vent to the outside; and c) an opening for introducing the molten metal into the die cavity after the surface portion has been removed.

2. The high-vacuum-suction casting apparatus according to above 1, wherein the opening is blocked with a consumable seal that dissolves as a result of contact with the molten metal.

3. The high-vacuum-suction casting apparatus according to above 2, wherein the consumable seal has 1) an easily ruptured portion and/or 2) an easily bent portion, the portion being a locally thin region for the consumable seal.

4. The high-vacuum-suction casting apparatus according to above 2, further comprising a pressure reduction vent for sucking a portion of the molten metal by depressurizing the inside of the feeding tube, the vent being disposed in a vicinity of the consumable seal and in a lower surface of the movable sealing member.

5. The high-vacuum-suction casting apparatus according to above 1, wherein at least one of a temperature sensor and optical fiber is installed in a vicinity of the pressure reduction vent or in a vicinity of the opening to judge a timing of movement of the movable sealing member.

6. The high-vacuum-suction casting apparatus according to above 1, further comprising an electric servo motor for at least carrying out movement of the movable sealing member.

7. A high-vacuum-suction casting method for producing cast products by raising up molten metal and introducing the molten metal into a die above, comprising:
(1) a first step of introducing the molten metal into a feeding tube and raising up the molten metal;
(2) a second step of removing the surface portion of the raised molten metal; and
(3) a third step of introducing the molten metal having a new surface, obtained as a result of removing the surface portion in the second step, into the die cavity under reduced pressure or a vacuum.

8. The high-vacuum-suction casting method according to above 7, wherein, after introducing the molten metal into the die cavity in the third step, an unsolidified portion of the molten metal in the die cavity is pressurized either immediately thereafter or after a passage of a predetermined length of time.

9. The high-vacuum-suction casting method according to above 7, wherein, as a result of cooling a portion of the feeding tube, a solid phase is made to precipitate in the molten metal in the cooled portion thereof by cooling, and the molten metal is stirred utilizing an action of electromagnetic force.

10. The high-vacuum-suction casting method according to above 7, wherein, after filling the molten metal into the die and closing the die, at least one step for removing a product and cleaning the die is carried out at a different location by moving 1) the die, 2) the feeding tube and the holding furnace or 3) the feeding tube.

11. The high-vacuum-suction casting method according to above 7, wherein, after filling the molten metal into the die and closing the die, the molten metal is discharged from below the feeding tube by allowing external gas pressure to act on the molten metal inside the feeding tube.

In addition, the present invention includes the following embodiments [1] to [9].

[1] A casting method and apparatus having at least a vent, between a die arranged in the upper portion of a holding furnace and a feeding tube immersed in the holding furnace, that reduces pressure inside the feeding tube on the feeding tube side at a seal, an opening and the lower portion of the seal, the inlet dimensions of this pressure reduction vent are made to be larger than the inside, a sealing plate (including that having a rod-like shape) is arranged having an internal groove depth of 2 mm or less, a gate located in the lower portion of the cavity of the die and the feeding tube located in the lower portion thereof are sealed by isolating with the seal, the die cavity is depressurized and the inside of the feeding tube is depressurized from the pressure reduction vent, and at the time molten metal is sucked and raised inside the holding furnace and the surface of the molten metal has flowed into the pressure reduction vent, the opening is moved between the gate and the feeding tube by driving the sealing plate, the die cavity is filled with the molten metal due to a pressure difference between the die cavity and the inside of the feeding tube, the gate is immediately closed by moving the sealing plate, the molten metal inside the feeding tube is separated from the die cavity, and external gas pressure is allowed to act on the molten metal inside the feeding tube through an external gas ventilation port provided in the sealing plate.

[2] The casting method and apparatus described in [1] above, wherein unsolidified melt in the die cavity is pressurized either immediately after or after the passage of a predetermined length of time after the gate has been closed.

[3] The casting method and apparatus described in [1] above, wherein the seal is that formed into the shape of a plate with an alloy or pure metal similar to the composition of the molten metal that is harmless even when melted in the molten metal, that formed into the shape of a plate with a material that has low reactivity with the molten metal, such as a carbon-based material, or that formed into the shape of a plate with a combination thereof, at least has an opening so as to allow the use of a consumable seal that decreases in strength or dissolves as a result of contact with the molten metal in the feeding tube resulting in disruption of the pressure difference between the die cavity and the feeding tube, has a vent for reducing pressure inside the feeding tube by contacting this opening and consumable seal, the inlet dimensions of this pressure reduction vent are larger than the inside, and uses a sealing plate having an internal groove depth of 2 mm or less.

[4] The casting method and apparatus described in [3] above, wherein the consumable seal used is provided with an easily ruptured portion and easily bent portion by providing a locally thin region.

[5] The casting method and apparatus described in [3] above, wherein a portion of the molten metal is sucked by providing a pressure reduction vent that depressurizes the inside of the feeding tube in the vicinity of the consumable seal and in the lower surface of the sealing plate.

[6] The casting method and apparatus described in [1] to [5] above, wherein a portion of the feeding tube is cooled, and a solid phase is precipitated in the molten metal of that cooled portion together with stirring the molten metal by allowing electromagnetic force to act thereon.

[7] The casting method and apparatus described in [1] to [6], wherein a step for pouring the molten metal, removing the product or cleaning the die and the like is carried out at a different location by moving the die, the feeding tube and the holding furnace or the feeding tube after having closed the gate.

[8] The casting method and apparatus described in [1], [3] or [5] wherein a temperature sensor or optical fiber is installed in the vicinity of the pressure reduction vent or in the vicinity of the opening to judge the timing of movement of the sealing member based on a change in the output thereof.

[9] The casting method and apparatus described in [1] to [8], wherein driving of the sealing plate, mold clamping, pressurization of the unsolidified molten metal, driving of an ejector pin and the like are carried out with one or more electric servo motors.

The following provides a more detailed explanation of embodiments of the high-vacuum-suction casting apparatus and high-vacuum-suction casting method of the present invention.

As shown in FIG. 1, the present apparatus has at least a seal (movable sealing member), an opening and a pressure reduction vent at lower portion of the seal for reducing pressure within a feeding tube. The seal, opening and pressure reduction vent are disposed between a die arranged above a holding furnace and the feeding tube immersed in the holding furnace. The sealing plate has the pressure reduction vent whose inlet dimensions are made to be larger than the inside having an internal groove depth of 2 mm or less, the gate located in the lower portion of the die cavity and the feeding tube are isolated and sealed, the die cavity is depressurized and the inside of the feeding tube is depressurized through the pressure reduction vent, and at the time molten metal is sucked and raised inside the holding furnace and the surface of the molten metal has flowed into the pressure reduction vent, the opening is moved between the gate and the feeding tube by driving the sealing plate, and the die cavity is filled with the molten metal due to a pressure difference between the die cavity and the inside of the feeding tube. Immediately thereafter, the sealing plate is further moved to shut the gate and the feeding tube to prevent the molten metal from dropping down. In addition, the molten metal in the feeding tube drops down into the holding furnace as a result of external air pressure nearly simultaneously acting on the molten metal in the feeding tube through an external air ventilator provided in the sealing plate. Furthermore, the molten metal that has flowed into the pressure reduction vent solidifies and stops flowing in a short period of time due to the thin cross-section of the flow path inside, the pressure reduction vent is sealed, and there is no entrance of external air from the pressure reduction vent when the molten metal is filled into the die cavity. Although a sealing plate (plate-shaped sealing member) is used as a sealing member in FIG. 1, the present invention is not limited thereto, but rather a cylindrical or rod-shaped sealing member, for example, can also be used.

Moreover, unsolidified melt in the die cavity is pressurized with a piston or gas pressure and the like either immediately after the gate closure or after a suitable amount of time as necessary.

The gate can also be sealed with a consumable seal as shown in FIG. 3 instead of with a portion of the sealing plate as described above. Examples of the consumable seal include that formed into the shape of a plate with an alloy or pure metal similar to the composition of the molten metal that is harmless even when melted in the molten metal, that formed into the shape of a plate with a material that has low reactivity with the molten metal, such as a carbon-based material, or that formed into the shape of a plate with a combination thereof, and a consumable seal can be used that decreases in strength or dissolves as a result of contact with the molten metal in the feeding tube resulting in disruption because of the pressure difference between the die cavity and the feeding tube. In addition, depending on the case, the consumable seal may be made to rupture easily by providing an easily ruptured portion and easily bent portion by providing a locally thin region in the consumable seal.

In the case of using such a consumable seal, a sealing plate has an opening at the location where the consumable seal is arranged (below the gate), as shown in FIG. 4, and a pressure reduction vent is at least formed for reducing pressure within the feeding tube so as contact the consumable seal with this opening. Similar to the case of not using a consumable seal, the inlet dimensions of this pressure reduction vent are made to be larger than the inside, and by making the internal groove depth 2 mm or less, the molten metal is made to solidify after having flowed therein to a certain extent. In addition, a similar pressure reduction vent is also provided in the lower portion of the sealing plate, and oxide films and the like on the surface of the molten metal that have risen up may be aspirated to prevent from flowing into the die cavity.

A portion of the feeding tube can be cooled to cause a solid phase to precipitate in the molten metal, and the molten metal can be stirred using the action of electromagnetic force and fill the die cavity with a slurry in which the precipitated solid phase has been granulated. Although a method similar to an induction motor is a simple method for generating the electromagnetic force, other methods may also be used such as the rotation of permanent magnet or a linear motor system.

A temperature sensor may be installed within 5 mm from the pressure reduction vent or the opening to judge the timing for driving the sealing plate. In addition, other methods may also be employed, such as utilizing the change in output of a transistor connected to an optic fiber.

The die is subsequently opened and the product is ejected, the die is cleaned and then reassembled and so forth at the same location. These steps may also be performed at another location with moving the die. Alternatively, only the feeding tube and the holding furnace or only the feeding tube may be moved without moving the mold.

In addition, although driving of the sealing plate, clamping of the die, driving of the product ejector pin and pressurization of unsolidified melt are carried out with one or more electric servo motors, a combination of a worm gear and a motor, hydraulic pressure or pneumatic pressure and the like may also be used.

ADVANTAGES OF THE INVENTION

Various advantages as indicated below are obtained according to the present invention as described above. First, as a result of installing a seal between the die cavity and the feeding tube, a high vacuum can easily be generated inside the die cavity since the die cavity can be depressurized independent of the feeding tube. This is because the locations to be depressurized are minimized, and the die cavity can be depressurized over time in the absence of the molten metal. However, although the timing of depressurization is normally within several seconds, which is longer than the case of ordinary vacuum die casting, the time is not excessively long so as to worsen productivity. In cases in which depressurization time is unavoidably long due to the generation of gas from a coated mold or due to the structure of the die or mold, the die cavity can be depressurized in advance by using a consumable seal as previously described. This is because, since the consumable seal is in the form of a thin plate, it is suctioned against the gate by the decrease in pressure in the die cavity, thereby enabling sealing to be carried out easily. In addition to the entrainment of gas being eliminated as a result of generating a high vacuum in the die cavity, there is little oxidation of the surface of the molten metal, thereby reducing entrainment of oxide film.

In addition, since the die cavity is filled with molten metal after discharging gas in the feeding tube by sucking and raising the molten metal by depressurizing at the uppermost end of the feeding tube, gas in the feeding tube does not enter the die cavity. Moreover, since oxide film, suspended debris and the like formed on the surface of the molten metal in the feeding tube are suctioned into a pressure reduction vent, they do not flow into the die cavity thereby preventing the occurrence of defects attributable thereto.

In the present invention, since the force acting on the feeding tube is small, conventional ceramics can be used for the feeding tube, thereby preventing the occurrence of solidification in the sleeve as in die casting and eliminating the need to lubricate the sleeve and so forth. Moreover, although it is necessary to prevent oxidation of the surface of the molten metal in the feeding tube, since the surface can be provided by creating an inert atmosphere of the least volume in the form of the volume inside the sleeve, the amount of atmospheric gas used is minimal thereby reducing costs. Since the present invention only requires a vacuum system for depressurizing the extremely small volume in the feeding tube and the volume of the die cavity, in comparison with low pressure casting equipment that pressurize the entire holding furnace, the equipment is smaller in size, has lower costs and uses less energy. In addition, work such as removing oxide films on the surface of the molten metal is easy, thereby reducing maintenance costs as well. Moreover, since the molten metal is not retained in the feeding tube for extended periods of time as in low pressure casting, energy loss can be minimized.

A dendritic solid phase is granulated when a portion of the feeding tube is suitably cooled, a solid phase is precipitated in the molten metal and a flow is generated by electromagnetic force. Since a slurry in this semi-solidified state has good flowability and a small solidification shrinkage rate, cast products of high dimensional accuracy are obtained with few casting defects. Furthermore, since conventional low pressure casting methods require a high temperature inside the furnace in order to pressurize the inside of the furnace and maintain the temperature of the gate, it is not easy to install this type of semi-solidification treatment unit in the feeding tube.

The unsolidified portion of the molten metal in the die cavity can be pressurized instantaneously by moving the sealing plate to close the gate and isolate the molten metal in the die cavity from the molten metal in the feeding tube. This is because, in the case of the present invention, the unsolidified portion of the molten metal in the die cavity can be pressurized directly with a preset piston and the like simply by moving the sealing plate several millimeters or more. In conventional casting methods other than die casting and the like, it is not easy to pressurize in a short period of time by closing the gate as an inlet in which the molten metal flows. As a result of this pressurization, even areas of extremely small dimensions, where it is difficult for molten metal to flow due to resistance caused by surface tension of the molten metal, can be filled before the melt solidifies, solidification and thermal shrinkage can be prevented, and cast products of high dimensional accuracy can be produced that are free of shrinkage cavity defects. In addition, since the gap between the casting and die is small, thermal contact resistance decreases and solidification rate increases, thereby not only resulting in high productivity since products can be removed after a short period of time, but also improved mechanical properties due to the increased fineness of the solidified structure in the case of Al alloy and the like.

In addition, although die casting methods utilize the action of high pressure since residual gas and entrained air bubbles are compressed in the die cavity, since a high vacuum is created in the die cavity in the present invention, the pressure is not required to be that high, and since the feeding tube, such as the pressurizing piston, is also short, the amount of energy used is low, the equipment is compact and costs are low, while also allowing die costs to be reduced due to the small load applied to the die.

Since the apparatus is installed so that an external gas ventilation port leading to the outside is located over the melt surface in the feeding tube when the gate is closed, following isolation of the molten metal, the molten metal is allowed to drop down into the holding furnace while aspirating external air or atmospheric gas. Consequently, use of nitrogen gas or argon gas and the like for the external gas makes it possible to prevent oxidation of the melt surface.

In the case of using the consumable seal described above, the seal ruptures as a result of dissolving or decreasing in strength due to the heat of the molten metal when the molten metal contacts the consumable seal. Namely, the consumable seal ruptures automatically when the molten metal is filled into the feeding tube, the molten metal is further aspirated, and is instantaneously filled into the die cavity. Thus, it is easy to control the movement of the sealing plate.

Since the sealing plate can be moved to a location that facilitates removal of solidified molten metal in the vicinity of the seal, removal work can be carried out efficiently. In addition, the consumable seal for the next casting is easily set in position.

In the case of using a consumable seal, since oxide films and fragments of refractory materials and the like on the surface of the molten metal can also be discharged from the lower portion of the sealing plate when the molten metal is aspirated to a certain degree in the same manner as the upper end thereof, a clean molten metal can be supplied to the die cavity. Although these effects are present to some extent in the upper end of the feeding tube as well, this method is effective when such effects are inadequate. Since the aspirated molten metal solidifies immediately in this case as well, gas from this portion is not aspirated into the die cavity.

Workability is improved by changing the molten metal pouring location or the work position following molten metal pouring, and productivity can be increased since multiple dies can be used.

The use of one or more servo motors for the drive unit makes it possible to conserve energy while also enabling the size of the equipment to be reduced as well as facilitating control.

EXAMPLES

Example 1

Example 1 is shown in FIG. 1. In the present embodiment, the space between a gate 3 of the lower portion of a die cavity 2 inside dies land 1' which corresponds to a shape of a product, and a feeding tube 6 in which a molten metal 5 is immersed in a holding furnace or melting furnace 4, is closed with a sealing plate 7 (shown from below in FIG. 2), and an opening 8 provided in the die cavity 2 and the sealing plate 7 is depressurized. In this state, the opening 8 is depressurized as a result of only being connected to the die cavity 2 through a thin plate-like groove. Although this groove is preferably formed in the sealing plate, it may also be provided in the lower portion of the die. Next, molten metal is sucked by depressurizing the inside of the feeding tube 6 through a feeding tube depressurizing pipe 9 and a pressure reduction vent 10 provided in the sealing plate in the upper portion of the feeding tube 6, causing the molten metal to rise while maintaining the surface of the molten metal nearly horizontal. Once the molten metal has flowed into the pressure reduction vent 10, the sealing plate 7 is immediately moved to the left and the opening 8 is arranged between the gate 3 and the feeding tube 6. At this time, a pressure difference between the die cavity 2 and the melt surface in the feeding tube. suddenly acts on the molten metal causing the molten metal to instantaneously fill the die cavity. Depressurization of the inside of the feeding tube 6 may be only a slight depressurization from atmospheric pressure to about −10 kPa in the case of Al alloy if the distance between the melt surface in the holding furnace 4 and the pressure reduction vent 10 is made to be 0.5 m. Although depressurization of the die cavity requires greater depressurization, depressurization can be carried out easily at about −90 kPa. Furthermore, the cross-sectional shape of the sealing plate may be, for example, rectangular, circular, trapezoidal or triangular.

Molten metal that has flowed into the pressure reduction vent 10 (containing an oxide film and suspended debris on the surface of the molten metal) is cooled and stops flowing since the cross-sectional thickness becomes smaller farther back in the pressure reduction vent 10. Although judgment of whether or not the molten metal has flowed into the pressure reduction vent 10 is based on an output from a thermocouple installed at a location 0.1 to 1 mm from the pressure reduction vent, an optic fiber and the like may also be used. Alternatively, the timing of seal movement may also be judged based on the degree of depressurization and time.

After the molten metal has filled the die cavity, the sealing plate 7 is immediately further moved to the left, the portion where the opening is not present closes the gate 3, and the molten metal in the die cavity 2 is isolated from the molten metal in the feeding tube 6. At this time, nitrogen gas in an external nitrogen tank flows into the feeding tube 6 from an external gas ventilator 11 provided in the sealing plate 7, and the molten metal drops down into the holding furnace while a nitrogen gas atmosphere is formed within the feeding tube 6 to prevent oxidation of the molten metal. Other gases such as argon gas may be used instead of nitrogen gas. In addition, in cases when oxidation of the molten metal is not that much of a problem, the external gas ventilator may simply be open to the atmosphere.

After isolating the molten metal, unsolidified molten metal in the die cavity 2 is immediately pressurized as necessary by a pressurizing piston 12 driven by an electric servo motor to accelerate solidification or to compensate for solidification shrinkage and prevent shrinkage cavity defects. Hydraulic pressure and the like may also be used to drive the pressurizing piston. Pressurization of the molten metal in the shortest possible time after closing the gate can be carried out using a limit switch, for example, so that pressurization begins once the sealing plate has moved a certain distance. In addition, the sealing plate is driven and moved to a location that facilitates removal of solidified portion of the molten metal in the vicinity of the pressure reduction vent 10 to remove the solidified portion either during or following completion of pressurization.

Instead of depressurizing the die cavity in the mold directly as described above, the die may be placed in a sealed container and this sealed container may be depressurized to depressurize the die cavity. In this case, pressurizing this sealed container with gas makes it possible to also pressurize the molten metal in the die cavity. In addition, a ceramic mold, plaster mold or sand mold, which generates less gas, may be used instead of a metal die.

Once the molten metal in the die cavity has solidified, although the product is removed at the same location, and casting is repeated after carrying out mold cleaning, mold coating and the like, molds 1 and 1' may be moved to another location followed by removing the product, cleaning the mold and so forth, and then reinstalling above the feeding tube 6 and repeating the steps described above. Alternatively, the holding furnace and the feeding tube, or only the feeding tube, may be moved without moving the mold followed by pouring the molten metal into another die.

Furthermore, although driving of the sealing plate is carried out with the electric servo motor 14 and a ball screw 15, it may also be driven by another method such as a pneumatic or hydraulic cylinder and a worm gear or an electric motor. In addition, the die 1 may have vertical split surfaces as in FIG. 1, or horizontal split surfaces as shown in FIG. 3.

Example 2

In FIG. 3, a pure Al plate having a thickness of about 100 μm is used as a consumable seal 16 for the seal of the gate 3. The structure of the sealing plate in this case is shown in FIG. 4. The consumable seal 16 is installed by moving the sealing plate 7 to the left, placing the consumable seal 16 at a holding section, and moving to the upper portion of the feeding tube 6. When the die cavity 2 is depressurized, the consumable seal 16 is adhered to the gate 3 by the attractive force thereof thereby sealing the gate 3. Alternatively, a consumable seal may be affixed to the gate 3 at another location while depressurizing the die cavity.

Subsequently, the inside of the feeding tube is depressurized from the feeding tube depressurizing pipe 9 through pressure reduction vents 10 and 17 in the upper end of the feeding tube 6. When the surface of the molten metal reaches the pressure reduction vent 17, oxide films and molten metal having the possibility of containing suspended debris are sucked. Next, the following clean molten metal reaches and flows into the pressure reduction vent 10. At the same time, the molten metal surface contacts the consumable seal 16, the consumable seal either decreases in strength or dissolves, and consumable seal instantaneously ruptures as a result being unable to withstand the pressure difference between the inside of the die cavity and the pressure of the molten metal, and the molten metal fills the die cavity 2. The subsequent steps are the same as those of Example 1. Furthermore, although the molten metal can be filled into the die cavity at a higher pressure by pressurizing the melt surface in the holding furnace 4 after the molten metal has reached the pressure reduction vent 10, this results in increased equipment and maintenance costs. In addition, the pressure reduction vent 17 can be omitted if soiling of the surface of the molten metal in the feeding tube is not significant.

Example 3

FIG. 5 shows Example 3 in which a portion 19 of the feeding tube 6 is made of graphite or silicon nitride having high thermal conductivity, the portion of the feeding tube 6 is cooled by air cooling or by employing a cold crucible-like structure (water-cooled copper cylinder provided with slits), a solid phase is made to precipitate in the molten metal simultaneous to stirring the molten metal using the action of electromagnetic force and then supplying the molten metal to the die cavity in the same manner as Example 1 or 2 with the precipitated solid phase in a granulated state. In addition to using the principle of an electric motor, electromagnetic force may be applied by other methods such as rotating a permanent magnet or using the principle of a linear motor. A combination of these methods may also be used. In addition, the electromagnetic stirring described above may also be carried out in a horizontal portion by having the feeding tube protrude outside the holding furnace as shown in FIG. 6. This is effective in cases in which the precipitated solid phase settles in the feeding tube due to high density thereof.

INDUSTRIAL APPLICABILITY

The present invention can be used for various metal or resin casting, and particularly for casting of Al alloys, Mg alloys and Zn alloys and the like, as an alternative to various conventional method such as casting methods, die casting methods or resin injection molding.

The invention claimed is:

1. A high-vacuum-suction casting apparatus for producing cast products by raising up molten metal and introducing the molten metal into a die above, comprising:

(1) a holding furnace for retaining the molten metal;

(2) the die arranged above the holding furnace;

(3) a feeding tube for supplying the molten metal from the holding furnace to a die cavity; and (4) a horizontally movable sealing member capable of opening and closing a space between a gate provided in a bottom of the die and the outlet of the feeding tube, wherein the sealing member comprises:

a) a pressure reduction vent for removing a surface portion of the molten metal, including a surface of the molten metal and some molten metal directly below the surface, sucked into the feeding tube by reducing pressure in the feeding tube;

b) a depressurizing pipe for discharging aspirated gas from the pressure reduction vent to the outside; and c) an opening directly communicating the outlet of the feeding tube and the die cavity.

2. The high-vacuum-suction casting apparatus according to claim 1, wherein the opening is blocked with a consumable seal that dissolves as a result of contact with the molten metal.

3. The high-vacuum-suction casting apparatus according to claim 2, wherein the consumable seal has 1) an easily ruptured portion and/or 2) an easily bent portion, the portion being a locally thin region for the consumable seal.

4. The high-vacuum-suction casting apparatus according to claim 2, further comprising a pressure reduction vent for sucking a portion of the molten metal by depressurizing the inside of the feeding tube, the vent being disposed in a vicinity of the consumable seal and in a lower surface of the movable sealing member.

5. The high-vacuum-suction casting apparatus according to claim 1, wherein at least one of a temperature sensor and optical fiber is installed in a vicinity of the pressure reduction vent or in a vicinity of the opening to judge a timing of movement of the movable sealing member.

6. The high-vacuum-suction casting apparatus according to claim 1, further comprising an electric servo motor for at least carrying out movement of the movable sealing member.

* * * * *